United States Patent [19]

Osakabe

[11] 3,941,931

[45] Mar. 2, 1976

[54] AUDIO SIGNAL MIXING SYSTEM

[75] Inventor: Yoshio Osakabe, Yokohama, Japan

[73] Assignee: Sony Corporation, Tokyo, Japan

[22] Filed: Feb. 11, 1974

[21] Appl. No.: 441,206

[30] Foreign Application Priority Data

Feb. 12, 1973 Japan ..... 48-18303[U]

[52] U.S. Cl. ..... 179/1 G

[51] Int. Cl.[2] ..... H04R 5/00

[58] Field of Search ..... 179/1 G, 1 J, 1 VC, 1 GQ

[56] References Cited

UNITED STATES PATENTS

| | | | |
|---|---|---|---|
| 3,200,199 | 8/1965 | Bang | 179/1 G |
| 3,249,696 | 5/1966 | Van Sickle | 179/1 G |
| 3,272,906 | 9/1966 | De Vries et al. | 179/1 J |
| 3,478,167 | 11/1969 | Sorkin | 179/1 G |
| 3,518,375 | 6/1970 | Hawkins | 179/1 VC |
| 3,665,105 | 5/1972 | Chowning | 179/1 J |

*Primary Examiner*—Kathleen H. Claffy
*Assistant Examiner*—Douglas W. Olms
*Attorney, Agent, or Firm*—Hill, Gross, Simpson, Van Santen, Steadman, Chiara & Simpson

[57] ABSTRACT

An audio signal mixing system having left and right channels to transmit stereophonic left and right signals and each containing monaural signals and having left and right loudspeakers to reproduce the stereophonic signals, which includes a circuit for eliminating the monaural signal in one of the left and right channels, and also includes a mixing circuit for mixing a signal derived from a microphone in the other channel with the stereophonic signals, so that two different kinds of monaural signals as well as the stereophonic signals are reproduced by each loudspeaker.

9 Claims, 2 Drawing Figures

109L
109R
108L
108R
l
r
142L
151
142R
152
104L
104R
152a
105L
-Mo
-2Mo
151a
-Mo
ATT
117
+Vcc
BPF
141L
141R
105R
BPF
+Vcc
-L
L
R
-R
Z3
Z4
SIGNAL EMPHASIS
116
103L
103R
2Mo
BPF
115
112L
113L
114
L
101L
R
101R
112R
113R

AUDIO SIGNAL MIXING SYSTEM

BACKGROUND OF THE INVENTION

1. Field of the Invention

The present invention relates generally to an audio signal mixing system, and more particularly to a novel system which mixes additional signals with the stereophonic signals.

2. Description of the Prior Art

A microphone mixing circuit has been proposed which can reproduce a live singer's voice through a speaker with background music from, for example, a recording. However, with prior art microphone mixing circuits, the singer's voice from the recording and the live singer's singing voice appear localized at the center point between left and right speakers and hence the sound image of the live singer is superimposed on the sound image of the recorded singer at the center. In this specification "live singer" indicates that the performer is physically present and performing and "recorded singer" refers to sound from a recording.

To avoid this drawback, circuits which attenuate the reproduced signal from the record which amplify the signal from the microphone have been considered. In such methods or circuits, however, the music from the record will also be attenuated which is undesirable.

A method has been proposed in which the center vocal signal or monaural signal contained in the stereophonic signals is eliminated and a signal from a microphone is added on to the stereophonic signals. With this method, the sound of a user and the sound from a record will be reproduced from the same speaker. In this method, however, the singer's voice on the recording will be entirely eliminated and it is nearly impossible to compare the user's voice with the singer's voice.

SUMMARY OF THE INVENTION

An audio signal mixing system according to the present invention has a mixing circuit that provides that the monaural signal contained in the stereophonic signals is reproduced from one of the loudspeakers located at left and right positions and provides additional sound from the other loudspeaker.

It is an object of the present invention to provide a novel audio signal mixing system free of the drawbacks of the prior art.

Another object of the invention is to provide an audio signal mixing system which provides that the monaural signal contained in the stereophonic signals is reproduced through one of two left and right loudspeakers, or alternately is localized between the speakers with an additional signal reproduced through the other loudspeaker or localized between the left and right loudspeakers.

A further object of the invention is to provide an audio signal mixing system in which the monaural signal contained in stereophonic signals is reproduced through one of two left and right loudspeakers and the signal from a microphone is reproduced through the other loudspeaker to produce a duet effect.

A further object of the invention is to provide an audio signal mixing system in which the monaural signal contained in stereophonic signals is reproduced through one of two left and right loudspeakers and also through the other loudspeaker after being passed through a sound emphasis circuit including a delay unit to produce a duet effect.

A yet further object of the invention is to provide an audio signal mixing system in which stereophonic signals containing the center vocal signal are reproduced from media such as, for example, a record disc or a magnetic tape and a signal is also reproduced from a microphone and wherein the stereophonic signals are supplied to left and right loudspeakers, and the monaural signal is supplied to one of the loudspeakers, and the signal from the microphone is supplied to the other loudspeaker to produce a special effect in the reproduced sound.

A still further object of the invention is to provide an audio signal mixing system which is easily operated and which provides the user with great flexibility of use.

The other objects, features, and advantages of the invention will become apparent from the following description taken in conjunction with the accompanying drawings.

DESCRIPTION OF THE PREFERRED EMBODIMENTS

In general, if it is assumed that the left channel signal of a pair of stereophonic signals is L and the right channel signal is R, such left and right channel signals L and R can be expressed as follows:

$$\left.\begin{aligned} L &= M + LO \\ R &= M + RO \end{aligned}\right\} \quad (1)$$

where M represents the monaural signal to be localized at the center between the left and right loudspeakers and might be the vocal signal of a singer which has the same phase and level in both signals L and R, LO represents a signal which is supplied primarily to the left loudspeaker and RO represents a signal which is supplied primarily to the right loudspeaker.

If the signals L and R are added together, the following equation is obtained:

$$L + R = 2M + LO + RO \quad (2)$$

If one half of the signal (L+R) is subtracted from the left signal L, the following equation is obtained:

$$L - \tfrac{1}{2}(L + R) = \tfrac{1}{2}(LO - RO) \quad (3)$$

If the signal $\tfrac{1}{2}-(LO + RO)$ is supplied to the left speaker and the signal $R = M + RO$ is supplied to the right speaker, the singer's vocal sound (the signal M)) which is desired to be localized at the center will be localized at the right speaker. If at the same time an additional signal such as a user's vocal sound signal or singer's delayed vocal sound signal is supplied to the left speaker, the vocal sound due to the additional signal will be localized at the left speaker. This allows the singer's vocal sound and the vocal sound of the user to be listened to as a duet.

Figure 1:
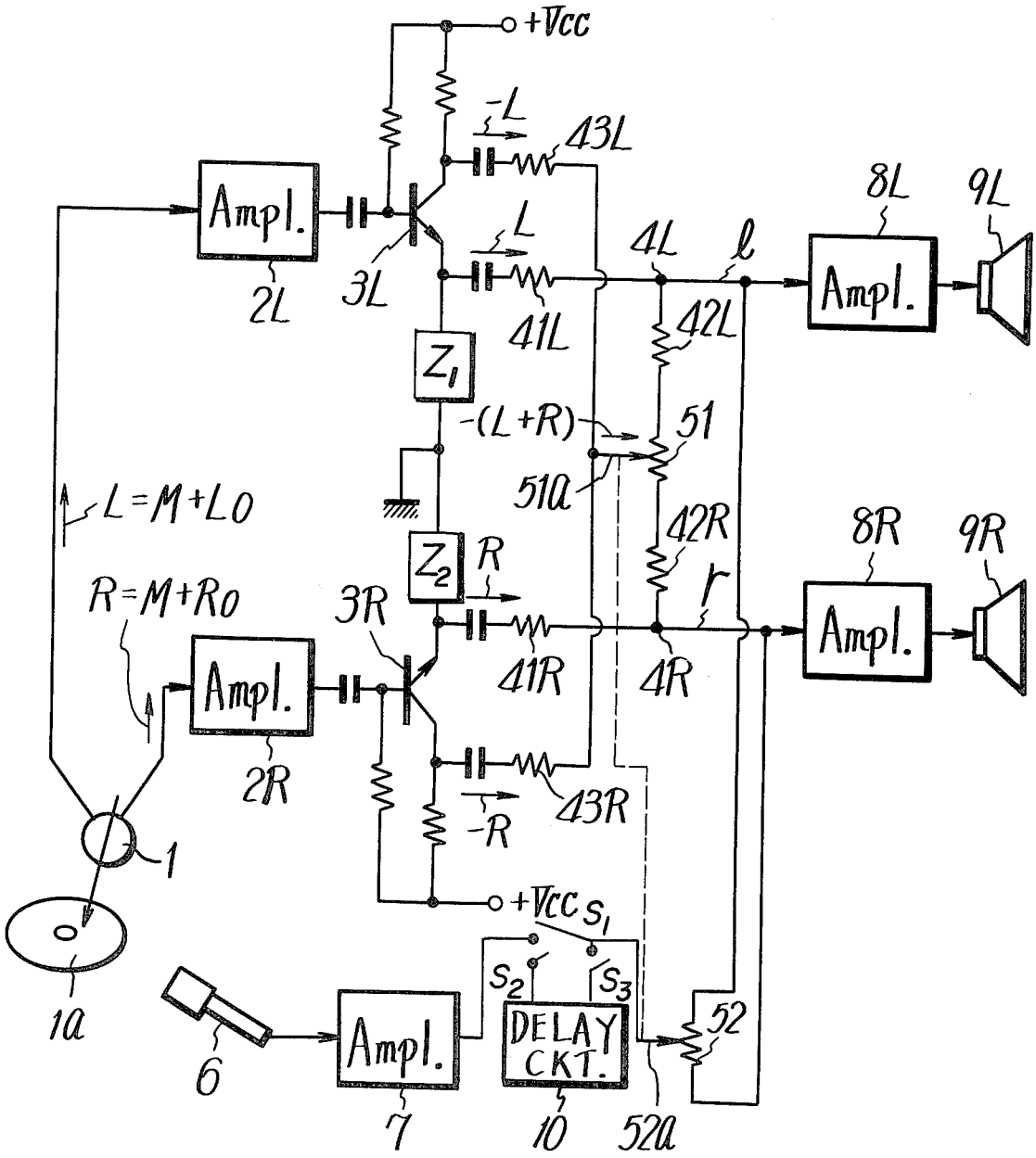
FIG. 1 is a circuit diagram showing an embodiment of audio signal mixing systems according to the present invention.

FIG. 1 illustrates an embodiment in which the stereophonic signals recorded on a signal source such as, for example, a phono record 1*a* are converted by a cartridge 1 of a record player to electrical signals for the left channel signal L and the right channel R. These signals are assumed to contain, respectively, the monaural signals expressed by equation (1). The electrical signals L and R are respectively amplified by equalizer-amplifiers 2L and 2R, and then applied to phase inverters or transistors 3L and 3R. In the illustrated embodiment the emitters of these transistors are grounded through impedances Z1 and Z2. Between the emitters of transistors 3L and 3R there is connected a resistive network comprising series connected resistors 41L, 42L, a variable resistor 51 and resistors 42R, 41R. Between the collectors of transistors 3L and 3R are connected series resistors 43L and 43R. The connection point between resistors 43L and 43R is connected to a slide contact arm 51*a* of variable resistor 51.

A microphone 6 may provide an additional signal. The output signal from the microphone 6 is applied through a microphone-amplifier 7 to a slide contact arm 52*a* of a variable resistor 52. The slide contact arms 51*a* and 52*a* of variable resistors 51 and 52 are ganged together. The variable resistor 52 is connected between the input terminals of main amplifiers 8L and 8R. The input terminal of main amplifier 8L is connected to the connection point 4L between resistors 41L and 42L, and the input terminal of main amplifier 8R is connected to the connection point 4R between resistors 42R and 41R. The variable resistor 51 has a higher impedance than resistors 41L to 43R.

The signal delivered to the connection point 4L is supplied through a left channel *l* and left main amplifier 8L to a left loudspeaker 9L, and the signal delivered to the connection point 4R is supplied through a right channel *r* and right main amplifier 8R to a right loudspeaker 9R.

In the above circuit, signals −L and L appear at the collector and emitter respectively, of transistor 3L, and signals −R and R appear at the collector and emitter respectively, of transistor 3R. The signals −L and −R which appear at the collectors of transistors 3L and 3R are added together through the resistors 43L and 43R to obtain a sum signal −(L+R) which is supplied to the slide contact arm 51*a* of variable resistor 51. If the slide contact arm 51*a* of variable resistor 51 is at the upper end of resistor 51 relative to FIG. 1 (near connection point 4L), the signal −(L+R) applied to the slide arm 51*a* will be converted to the signal −½(L+R) by the resistor 42L and the signal $-\frac{1}{2}(L+R)$ will be applied to the connection point 4L. In this case, since the signal L which appears at the emitter of transistor 3L is also applied to the connection point 4L, the signals − ½(L+R) and L are added at connection point 4L to obtain the signal ½ (LO − RO) expressed by equation (3) which appears at the connection point 4L. The signal ½(LO − RO) is supplied through the left main amplifier 8L to the speaker 9L. In this case, it will be noted that the signal of the equation (3) contains no monaural signal component M. Thus, the singer's vocal sound will not be reproduced from the speaker 9L.

On the other hand, the signal R which appears at the emitter of transistor 3R is applied to the connection point 4R, but since the slide contact arm 51*a* is in the upper position near the connection point 4L, the signal −(L+R) applied to the slide contact arm 51*a* is not applied to the connection point 4R, primarily because of the resistor 42R. Accordingly, only the signal R is applied to the connection point 4R and the signal R = M + RO is supplied through the right main amplifier 8R to the speaker 9R and is reproduced.

Thus, when the slide contact arm 51*a* of variable resistor 51 is positioned relative to resistor 51 near the connection point 4L, the left speaker 9L will be supplied with the signal ½ (LO − RO) and the right speaker 9R will be supplied with the signal (M + RO). In this case, the stereophonic signals (signals LO and RO), for example, music signals are reproduced through the left and right speakers 9L and 9R and the singer's vocal signal (signal M) is reproduced through the right speaker.

Also, if the slide contact arm 52*a* of variable resistor 52 is positioned at the upper end of resistor 52 in FIG. 1 (the end near the connection point 4L), the signal from the microphone 6 will be substantially applied to the connection point 4L only and will not be applied to the connection point 4R. Thus, if a user sings into the microphone 6, the music from the record 1*a* will be reproduced from the left and right speakers 9L and 9R, the singer's vocal sound will be reproduced from the right speaker 9R, and the user's vocal sound will be reproduced from the left speaker 9L. In other words, the user can sing in duet with the singer on the record with the music on the record 1*a* as background music.

In the case where both the slide contact arms 51*a* and 52*a* of variable resistors 51 and 52 are moved so that they are positioned near the connection point 4R, the user's vocal sound and the singer's vocal sound will be reproduced in opposite relation and the singer's vocal sound will be emitted from speaker 9L and the user's vocal sound from speaker 9R.

If the slide contact arms 51*a* and 52*a* are both centered relative to their resistors, the signal −(L + R) fed to the slide contact arm 51*a* will not be applied to either connection points 4L or 4R, and the factor for the term (LO − RO) in the equation (3) will be substantially zero, and the speakers 9L and 9R will be supplied only with the signals L and R, respectively. Consequently, the singer's vocal sound will be localized at the center. In this case, since the output signal of microphone 6 is divided equally by the variable resistor 52 and equally applied to the connection points 4L and 4R, the user's vocal sound will be localized at the center between the speakers.

If the slide contact arms 51*a* and 52*a* of variable resistors 51 and 52 are adjusted to intermediate positions, the factor for the term (LO − RO) in the equation (3) will be varied from 0 to ½, as a function of the position of the arms 51*a* and 52*a*. Thus, if the slide arms 51*a* and 52*a* are sequentially moved between the connection points 4L and 4R, the sound image of the singer's vocal sound will move sequentially from the right speaker 9R to the left speaker 9L, and the sound image of the user's vocal sound will move sequentially from the left speaker 9L to the right speaker 9R. Thus, the sound images produced by the singer's and the user's vocal sounds are symmetrically localized with respect to the center and the relative position and distance therebetween can be easily changed by adjusting the slide contact arms 51*a* and 52*a*.

The present invention allows the user to enjoy singing a duet with the singer on the record and the position and the distance between these two sources be changed arbitrarily, and the microphonemixing effect is greatly increased.

If a delay circuit 10 is inserted between the microphone amplifier 7 and the slide contact arm 52*a* of the variable resistor 52 as shown in block in FIG. 1, the duet effect will be further enhanced. Switch S1 allows direct connection between amplifier 7 and contact 52*a* when closed. Switches S2 and S3 connect delay circuit 10 between amplifier 10 and contact 52*a*.

The transistors 3L and 3R illustrated in the embodiment of FIG. 1, can be each replaced by differential amplifiers to obtain the same effect.

Figure 2:
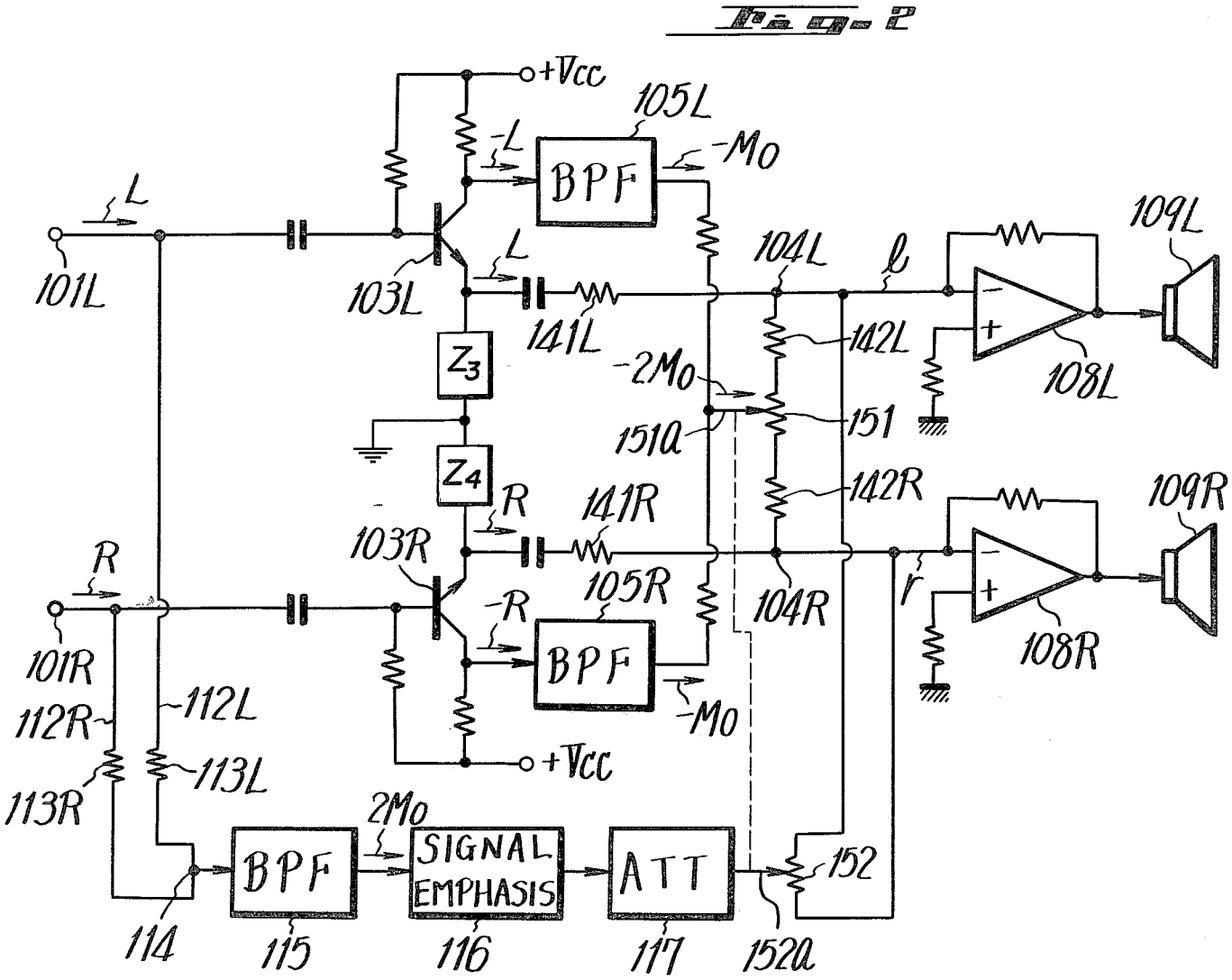
FIG. 2 is a circuit diagram showing another embodiment of the invention.

The embodiment of FIG. 2 utilizes the singer's vocal sound as the additional signal, and the left and right stereophonic signals L and R are applied to input terminals 101L and 101R and then applied to transistors 103L and 103R which have their emitters connected through impedances Z3 and Z4 to ground, respectively, as in the case of FIG. 1. In this embodiment, it is assumed that the left and right signals L and R consist of the signal components expressed by equation (1). Band pass filters 105L and 105R, each of which have a center frequency the same as the frequency of a human voice, for example, 800 Hz, are connected to the collectors of transistors 103L and 103R, respectively. The output terminals of band pass filters 105L and 105R are connected together and to a slide contact arm 151*a* of a variable resistor 151. A signal −2MO corresponding to the singer's vocal sound appears at the slide contact arm 151*a*. Opposite ends of variable resistor 151 are respectively, connected through resistors 142L and 142R to connection points 104L and 104R. Connection point 104L is between a resistor 141L and the input terminal of an operational amplifier 108L. Connection point 104R is between a resistor 141R and the input terminal of an operational amplifier 108R. The opposite ends of resistors 141L and 141R are respectively connected to the emitters of transistors 103L and 103R. Thus, the connection points 104L and 104R are supplied with the signals L and R from the emitters of transistors 103L and 103R, and are respectively connected through left and right channels *l* and *r* and the operational amplifiers 108L and 108R to left and right speakers 109L and 109R, as in the embodiment of FIG. 1.

Conductors 112L and 112R have first ends connected to the input terminals 101L and 101R and their other ends are connected together at point 114 through resistors 113L and 113R. A band pass filter 115, which has the same frequency characteristics as the band pass filters 105L and 105R is connected to the connection point 114 and produces at its output terminal the signal 2MO which corresponds to the singer's vocal sound. Thus, the signal 2MO is the additional signal in the embodiment of FIG. 2. The signal 2MO at the output of filter 119 is applied to a signal emphasis circuit 116 which includes a delay element. In a practical embodiment of the signal emphasis circuit 116, a delay circuit, a vibrato circuit and/or a vibration circuit can be used. A charge transfer device can be used as the delay element. In a practical embodiment of the present invention, the signal emphasis circuit 116 is formed of a delay circuit which has a time delay of about 60 milliseconds, and the output signal from the band pass filter 115 will be delayed by the circuit 116 about 60 milliseconds, and is then supplied to a slide contact arm 152*a* of a variable resistor 152 through an attenuator 117 which attenuates the input signal level by one half.

In the embodiment of FIG. 2, when the slide contact arms 151*a* and 152*a* of variable resistors 151 and 152 are positioned at the top of resistors 151 and 152 near the connection point 104L, the signal (LO + MO) will be reproduced through left speaker 109L and the signal (RO + MO) will be reproduced through right speaker 109R. In this case, it should be noted that since the signal component MO in the signal (LO + MO) is delayed by the delay circuit about 60 milliseconds, the singer's vocal sound will be first reproduced through the right speaker 109R and about 60 milliseconds later, will be reproduced through the left speaker 109L. Thus, the user can listen to a so-called one person duet.

If the signal emphasis circuit 116 is formed of a vibration circuit, when the slide contact arm 152*a* of variable resistor 152 is positioned adjacent connection point 104L, the singer's vocal sound will be first reproduced from the right speaker 109R and his reverberation sound will be reproduced from the left speaker 109L through the circuit 116. In this case, the listener gets the impression that the singer's vocal sound moves from the right speaker 109R to the left speaker 109L while being attenuated. Other effects can, of course, be obtained by moving contacts 151*a* and 152*a*.

With the embodiments of the present invention, the signals applied to the slide contact arm of the first variable resistor are obtained respectively at the collectors of the transistors, but it is possible to use a transformer instead of a transistor.

It will be apparent that many modifications and variations could be effected by those skilled in the art without departing from the spirit and scope of the novel concepts of the present invention.

I claim as my invention:

1. An audio signal mixing system comprising:

a. left and right channels for transmitting stereophonic left and right signals L and R each, respectively, containing a monaural signal;

b. a first circuit for eliminating said monaural signal contained in either one of said left and right signals L and R; and c. a second circuit supplied with an additional signal and mixing it with either one of said left and right signals L and R, whereby said either one of said left and right signals L and R and said additional signal are passed by one of said left and right channels, and the other one of the L and R signals and the monaural signal are passed by the other channel.

2. An audio signal mixing system as claimed in claim 1, wherein said first circuit comprises a first variable resistor with a slide contact arm connected between the left and right channels and said second circuit comprises a second variable resistor with a slide contact arm connected between the left and right channels, a signal of opposite polarity to said stereophonic signals L and R applied to said slide contact arm of said first variable resistor and said additional signal applied to said slide contact arm of said second variable resistor.

3. An audio signal mixing system as claimed in claim 2, wherein said slide contact arms of said first and second variable resistors are mechanically ganged together.

4. An audio signal mixing system as claimed in claim 2, wherein said slide contact arm of said second variable resistor is connected at one end of said second variable resistor to a microphone which furnishes said additional signal.

5. An audio signal mixing system as claimed in claim 4, wherein a delay circuit is connected between said microphone and the slide contact arm of said second variable resistor.

6. An audio signal mixing system as claimed in claim 2, wherein said left channel includes a first transistor having base, emitter and collector electrodes and said right channel includes a second transistor having base, emitter and collector electrodes, and the collector electrodes of said first and second transistor connected together and to said slide contact arm of said first variable resistor.

7. An audio signal mixing system as claimed in claim 1, wherein said first circuit includes a first variable resistor which has a slide contact arm and is connected between said left and right channels, first and second filters respectively connected to said left and right channels and passing signals corresponding to a frequency band of a human voice, and a means for applying the output signals from said first and second filters to said slide contact arm of said first variable resistor, and said second circuit includes a second variable resistor which is connected between said left and right channels and has a slide contact arm.

8. An audio signal mixing system as claimed in claim 7, further comprising a circuit for producing a signal which is the sum of said stereophonic left and right signals, L and R, a third filter connected to said sum signal producing circuit and passing a signal with a frequency band of a human voice, and a means for supplying the output signal from said third filter to said slide contact arm of said second variable resistor, whereby the signal with said frequency band of a human voice in said stereophonic signals becomes the additional signal.

9. An audio signal mixing system as claimed in claim 8, wherein a signal emphasis circuit is provided between said sum signal producing circuit and said slide contact arm of said second variable resistor, said signal emphasis circuit includes delay signal means.

* * * * *